US009525213B2

(12) United States Patent
Matsubara

(10) Patent No.: US 9,525,213 B2
(45) Date of Patent: Dec. 20, 2016

(54) ANTENNA DEVICE

(71) Applicant: Hitachi Metals, Ltd., Minato-ku, Tokyo (JP)

(72) Inventor: Ryoji Matsubara, Toshima (JP)

(73) Assignee: Hitachi Metals, Ltd., Tokyo (JP)

( * ) Notice: Subject to any disclaimer, the term of this patent is extended or adjusted under 35 U.S.C. 154(b) by 38 days.

(21) Appl. No.: 14/740,859

(22) Filed: Jun. 16, 2015

(65) Prior Publication Data

US 2016/0006117 A1 Jan. 7, 2016

(30) Foreign Application Priority Data

Jul. 3, 2014 (JP) ..... 2014-137502

(51) Int. Cl.

| | |
|---|---|
| ***H01Q 1/50*** | (2006.01) |
| ***H01Q 21/06*** | (2006.01) |
| ***H01Q 21/00*** | (2006.01) |
| ***H01Q 25/00*** | (2006.01) |
| *H01Q 21/24* | (2006.01) |

(52) U.S. Cl.

CPC ..... *H01Q 21/06* (2013.01); *H01Q 21/0006* (2013.01); *H01Q 25/005* (2013.01); *H01Q 21/24* (2013.01)

(58) Field of Classification Search

CPC ..... H01Q 1/50; H01Q 21/06; H01Q 25/005; H01Q 21/24; H01Q 21/0006

USPC ..... 343/702, 829, 846, 853

See application file for complete search history.

(56) References Cited

U.S. PATENT DOCUMENTS 8,179,322 B2 * 5/2012 Nissinen ..... H01Q 1/38 343/700 MS

2009/0273418 A1 * 11/2009 Shimizu ..... H01Q 13/10 333/24 R

FOREIGN PATENT DOCUMENTS

JP 2002-368507 A 12/2002

* cited by examiner

*Primary Examiner* — Jean B Jeanglaude

(74) *Attorney, Agent, or Firm* — Crowell & Moring LLP

(57) ABSTRACT

The antenna device includes a signal line that distributes input signals. The signal line includes a substrate, a pair of ground conductors opposite each other such as to sandwich the substrate, a first front side pattern and a second front side pattern formed on a front side of the substrate, and a first back side pattern and a second back side pattern formed on a back side of the substrate. While the first front side pattern is split, the second front side pattern is not split, and while the second back side pattern is split, the first back side pattern is not split. Parts of the split first front side pattern are conductive to each other via the first back side pattern, and parts of the split second back side pattern are conductive to each other via the second front side pattern.

8 Claims, 14 Drawing Sheets

ANTENNA DEVICE

CROSS-REFERENCE TO RELATED APPLICATION

The present application claims priority from Japanese Patent Application No. 2014-137502 filed on Jul. 3, 2014, the content of which is hereby incorporated by reference into this application.

TECHNICAL FIELD OF THE INVENTION

The present invention relates to an antenna device, and more particularly to a signal line in the antenna device.

BACKGROUND OF THE INVENTION

An antenna device having a plurality of antenna elements (radiating elements) is provided with signal lines that distribute input signals to each of the antenna elements. Such signal lines are formed by coaxial cables or microstrip lines and the like (Japanese Patent Application Laid-Open Publication No. 2002-368507: Patent Document 1). Sometimes different signal lines have to be intersected with each other depending on the wiring layout. When, for example, the signal lines are formed by microstrip lines, two wiring patterns may need to cross each other three-dimensionally on one side of the substrate.

SUMMARY OF THE INVENTION

The signal lines used in the antenna device are desired to have a minimum possible transmission loss, and also desired to be able to intersect with each other in the manner mentioned above.

A preferred aim of the present invention is to realize an antenna device with signal lines that have low transmission loss and that can be intersected with each other.

The antenna device of the present invention is an antenna device including a signal line that distributes input signals to a plurality of antenna elements. The signal line includes a substrate, a pair of ground conductors opposing each other and sandwiching the substrate, a first front side pattern and a second front side pattern formed on a front side of the substrate, a first back side pattern formed on a back side of the substrate and paired with the first front side pattern, and a second back side pattern formed on the back side of the substrate and paired with the second front side pattern. While the first front side pattern is split, the second front side pattern passes through a split portion in the first front side pattern and extends in a direction intersecting the first front side pattern. While the second back side pattern is split, the first back side pattern passes through a split portion in the second back side pattern and extends in a direction intersecting the second back side pattern. Parts of the split first front side pattern are conductive to each other via the first back side pattern. Parts of the split second back side pattern are conductive to each other via the second front side pattern.

In one aspect of the present invention, the split first front side pattern is connected to the first back side pattern via a through-hole formed in the substrate. The split second back side pattern is connected to the second front side pattern via a through-hole formed in the substrate.

In another aspect of the present invention, the second front side pattern includes a narrow portion that passes through the split portion in the first front side pattern and that has a width smaller than that of other portions. The first back side pattern includes a narrow portion that passes through the split portion in the second back side pattern and that has a width smaller than that of other portions.

In another aspect of the present invention, front side wide portions are formed on both sides of the narrow portion of the second front side pattern, and to the first front side pattern. Also, back side wide portions corresponding to the front side wide portions are formed on both sides of the narrow portion of the first back side pattern, and to each of a plurality of parts of the second back side pattern.

In another aspect of the present invention, front side filter patterns are added on both sides of the narrow portion of the second front side pattern, and to the first front side pattern. Also, back side filter patterns corresponding to the front side filter patterns are added on both sides of the narrow portion of the first back side pattern, and to the second back side pattern.

In another aspect of the present invention, front side wide portions are formed on both sides of the narrow portion of the second front side pattern, and back side wide portions corresponding to the front side wide portions are formed on the second back side pattern. Also, back side filter patterns are added on both sides of the narrow portion of the first back side pattern, and front side filter patterns corresponding to the back side filter patterns are added to the first front side pattern.

In another aspect of the present invention, the frequency of the signals propagating through the first front side pattern and first back side pattern is lower than the frequency of the signals propagating through the second front side pattern and the second back side pattern.

In another aspect of the present invention, at least one of the filter patterns has a meander shape or a spiral shape.

According to the present invention, an antenna device having signal lines that have low transmission loss and can be intersected with each other is achieved.

BRIEF DESCRIPTIONS OF THE DRAWINGS

DESCRIPTIONS OF THE PREFERRED EMBODIMENTS

First Embodiment

Hereinafter, a first embodiment of the antenna device of the present invention will be described in detail with reference to the drawings. The antenna device according to the present embodiment is an antenna device to be used in a base station for exchanging radio waves with a moving communication terminal such as a mobile phone.

Figure 1:
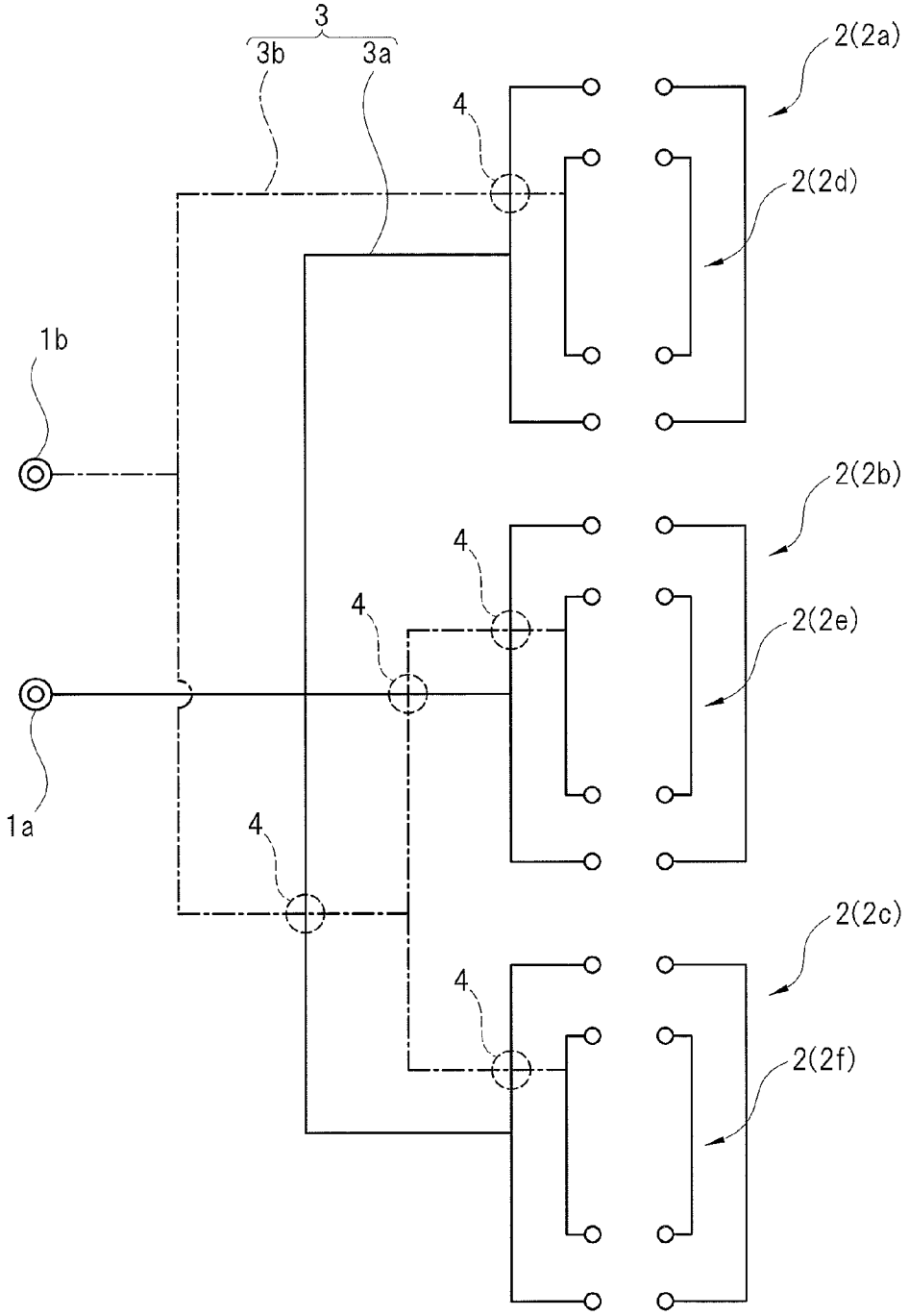
FIG. 1 is an explanatory diagram illustrating a configuration of an antenna device according to a first embodiment.

As illustrated in FIG. 1, the antenna device according to the present embodiment includes two input terminals 1*a* and 1*b*, a plurality of antenna elements 2*a*, 2*b*, 2*c*, 2*d*, 2*e*, and 2*f*, and signal lines 3 that connect the input terminals 1*a* and 1*b* with the antenna elements 2*a*, 2*b*, 2*c*, 2*d*, 2*e*, and 2*f*. In the following description, the antenna elements 2*a*, 2*b*, 2*c*, 2*d*, 2*e*, and 2*f* may be collectively referred to as "antenna elements 2".

A base-station antenna device is generally installed at a high place to exchange radio waves with a plurality of moving communication terminals below dotted around the station. Therefore, radio waves emitted from the base-station antenna device are generally given a downward tilt angle. To give the radio waves emitted from the antenna device a tilt angle, a phase circuit is arranged on the signal lines 3 illustrated in FIG. 1 so as to give a predetermined phase difference between the signals input to the respective antenna elements 2. For example, the antenna elements 2 are accommodated in a cylindrical or square-tube casing such that they are aligned along the longitudinal direction of the casing. The phase of the signal input to the respective antenna elements 2 is delayed stepwise in accordance with the order of arrangement of the antenna elements 2. That is, the phase of the signal input to the antenna element 2 arranged uppermost is advanced most, while the phase of the signal input to the antenna element 2 arranged lowermost is delayed most. This way, the radio waves emitted from the antenna device are given a tilt angle.

Signals output from a high-frequency circuit (not shown) are input to the input terminals 1*a* and 1*b* illustrated in FIG. 1. In the present embodiment, signals in the frequency range of 700 to 800 MHz are input to the input terminal 1*a*, while signals in the frequency range of 1.5 to 2.0 GHz are input to the input terminal 1*b*. Signals input to the input signal 1*a* are divided into three and input to each of the antenna elements 2*a*, 2*b*, and 2*c*. Signals input to the input terminal 1*b* are divided into three and input to each of the antenna elements 2*d*, 2*e*, and 2*f*. In other words, the three antenna elements 2*a*, 2*b*, and 2*c* are connected in parallel to the input terminal 1*a* via the signal line 3, while the three antenna elements 2*d*, 2*e*, and 2*f* are connected in parallel to the input terminal 1*b* via the signal line 3.

The signal lines 3 that distribute the signals input to the input terminals 1*a* and 1*b* and guide the signals to the predetermined antenna elements 2 as described above are formed by striplines. More specifically, each signal line 3 includes a substrate, wiring patterns formed on the front and back sides of the substrate, and a pair of ground conductors opposing each other and sandwiching the substrate.

In the signal lines 3, a plurality of intersecting portions 4 are present, because of the wiring layout. More specifically, a first signal line 3*a* (indicated with a solid line in FIG. 1) that connects the input terminal 1*a* with the antenna elements 2*a*, 2*b*, and 2*c* intersects with a second signal line 3*b* (indicated with a dot-dash chain line in FIG. 1) that connects the input terminal 1*b* with the antenna elements 2*d*, 2*e*, and 2*f* at least at five points. The structure of the signal line 3 will be described in more detail below.

Figure 2:
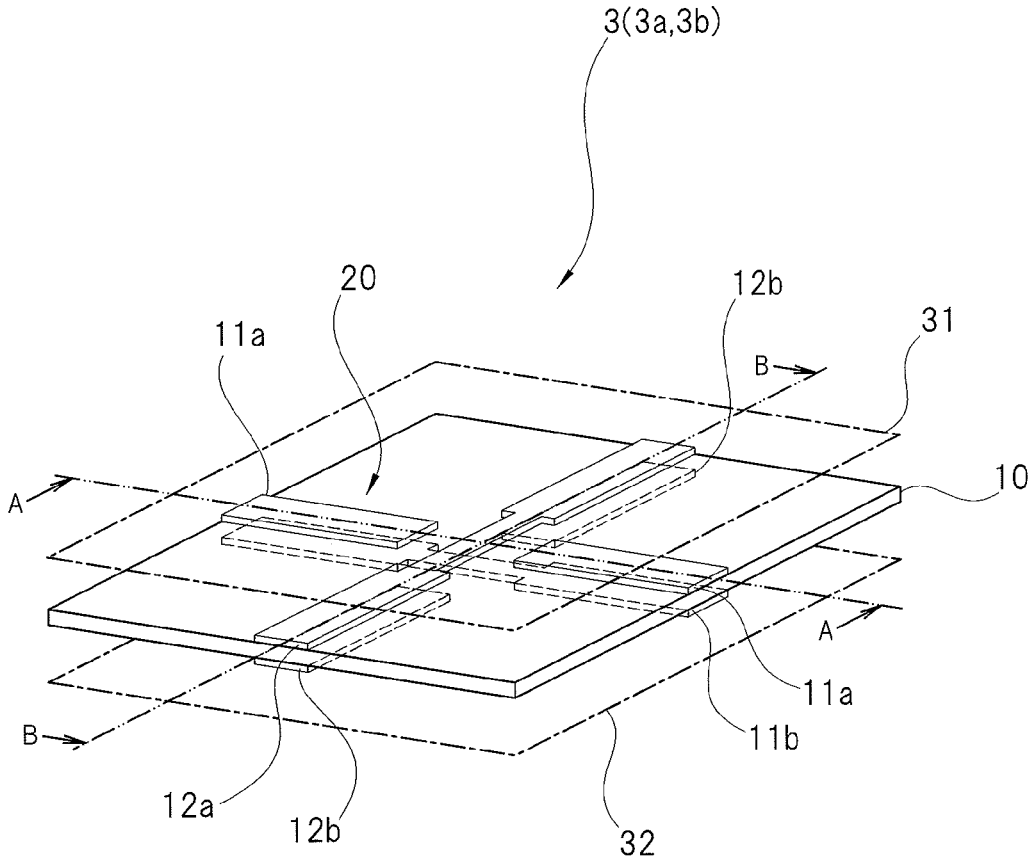
FIG. 2 is a schematic diagram illustrating the structure of a signal line at an intersecting portion.

As illustrated in FIG. 2, the signal line 3 includes the substrate 10, wiring patterns 20 formed on the front and back sides of the substrate 10, and a pair of ground conductors 31 and 32 opposing each other and sandwiching the substrate 10. The substrate 10 in the present embodiment is a printed substrate, and more particularly a glass epoxy substrate. The wiring patterns 20 in the present embodiment are made of metal foil, and more particularly of copper foil.

Figure 3:
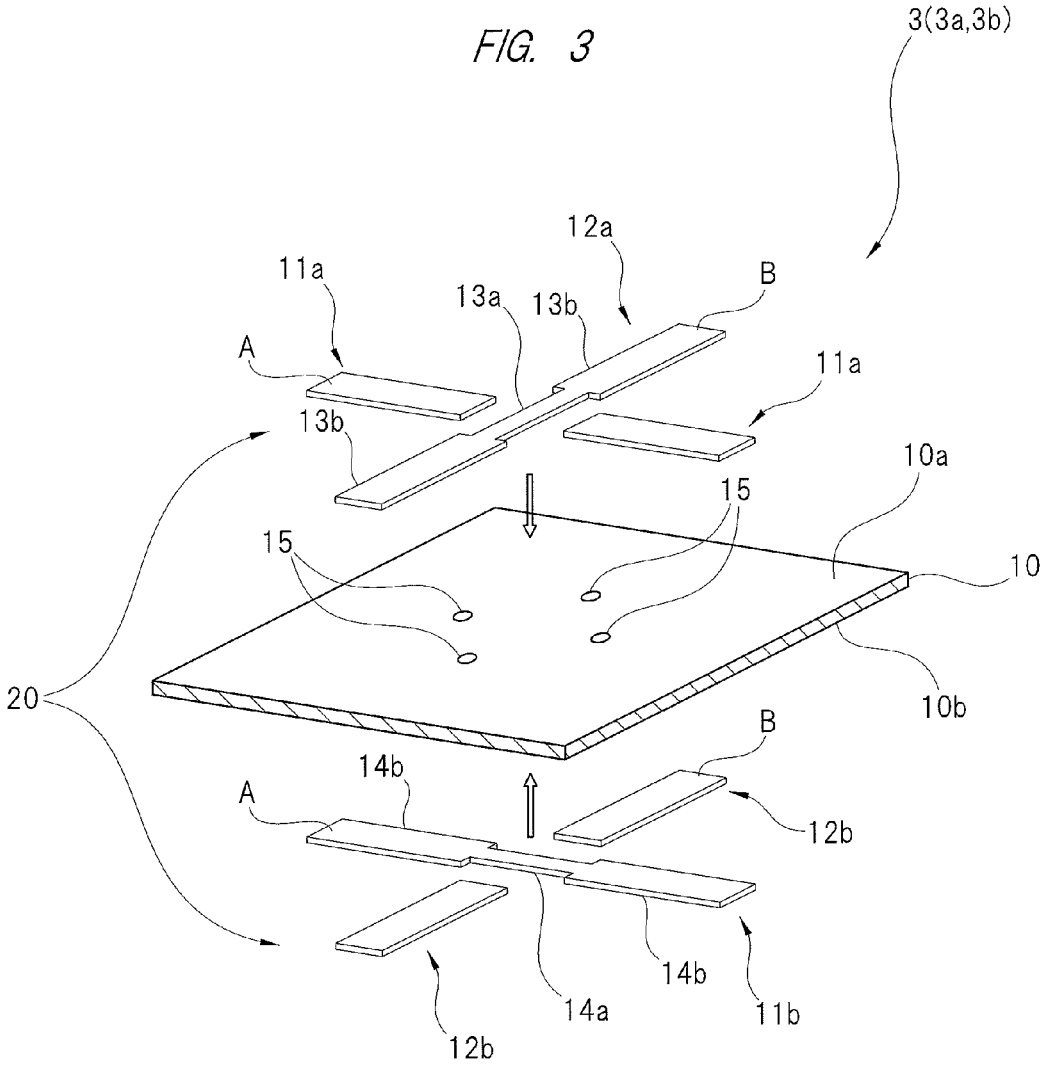
FIG. 3 is a schematic diagram illustrating one example of a wiring pattern.

As illustrated in FIG. 3, a first front side pattern 11*a* and a second front side pattern 12*a* are formed on the front side 10*a* of the substrate, while a first back side pattern 11*b* and a second back side pattern 12*b* are formed on the back side 10*b* of the substrate. The first front side pattern 11*a* and first back side pattern 11*b* sandwiching the substrate 10 are opposite and paired with each other to form the first signal line 3*a* illustrated in FIG. 1. On the other hand, the second front side pattern 12*a* and second back side pattern 12*b* sandwiching the substrate 10 are opposite and paired with each other to form the second signal line 3*b* illustrated in FIG. 1.

Figure 4A:
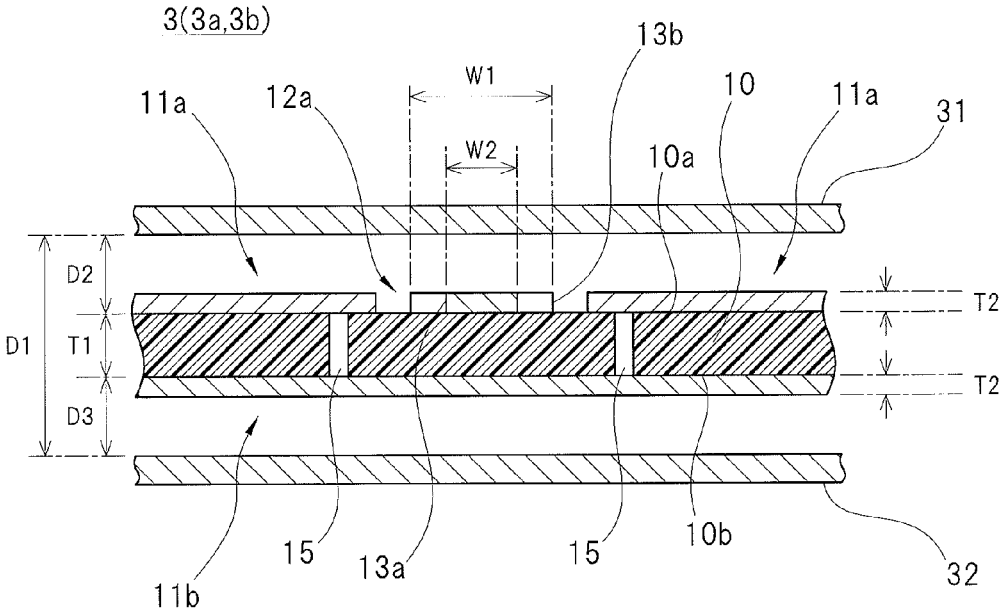
FIG. 4A is an enlarged cross-sectional view taken along the line A-A in FIG. 2.
Figure 4B:
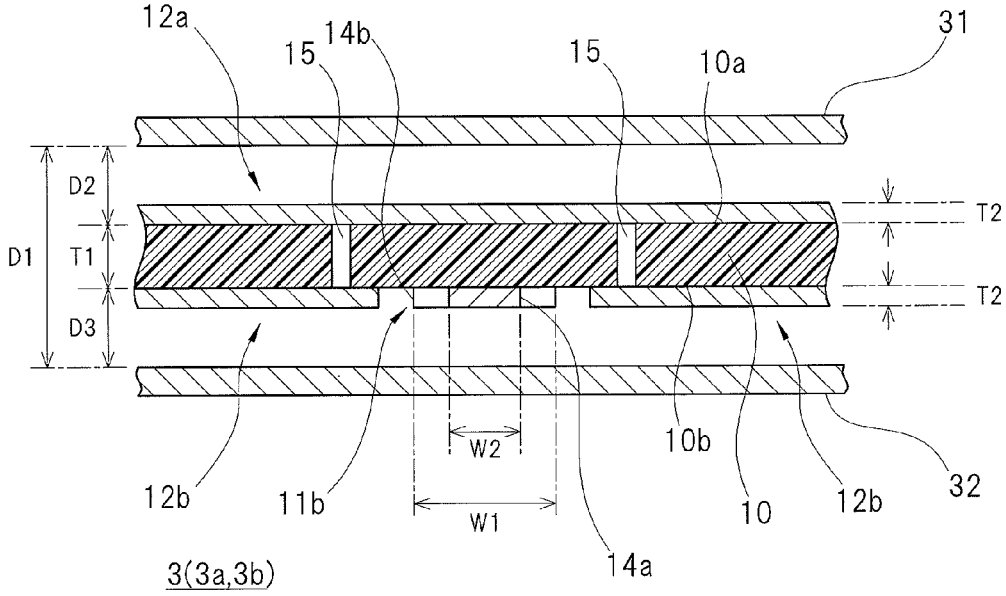
FIG. 4B is an enlarged cross-sectional view taken along the line B-B in FIG. 2.

As illustrated in FIG. 4A and FIG. 4B, the substrate 10 and ground conductor 31 are opposite each other interposing a gap, and the substrate 10 and ground conductor 32 are opposite each other interposing a gap, too. That is, the substrate 10 and the ground conductor 31 are opposite each other via an air layer, and the substrate 10 and the ground conductor 32 are opposing each other interposing an air layer, too. The substrate 10 illustrated in FIG. 4A and FIG. 4B has a thickness (T1) of 0.8 mm. The substrate 10 has a relative permittivity of 4.4, and a dielectric dissipation factor of 0.02. The distance (D1) between the ground conductor 31 and the ground conductor 32 is 5.0 mm. The distance (D2) between the substrate 10 and ground conductor 31, and the distance (D3) between the substrate 10 and ground conductor 32, respectively, are 2.1 mm. The components supporting the substrate 10 and the ground conductors 31 and 32 are not illustrated in the drawings attached to this application.

The structure described above is common to the entire signal line 3 including all the intersecting portions 4 illustrated in FIG. 1. Next, the structure of the signal line 3 at each intersecting portion 4 illustrated in FIG. 1 will be described.

As illustrated in FIG. 3, the first front side pattern 11*a* is split at each of the intersecting portions 4 (FIG. 1). On the other hand, the second front side pattern 12*a* passes through a split portion in the first front side pattern 11*a* and extends in a direction intersecting the first front side pattern 11*a* at each intersecting portion 4 (FIG. 1). That is, while the first front side pattern 11*a* is split at a plurality of points on the front side 10*a* of the substrate, the second front side pattern 12*a* is continuous and not split on the front side 10*a* of the substrate.

As illustrated in FIG. 3, the second back side pattern 12*b* is split at each of the intersecting portions 4 (FIG. 1). On the other hand, the first back side pattern 11*b* passes a split portion in the second back side pattern 12*b* and extends in a direction intersecting the second back side pattern 12*b* at each intersecting portion 4 (FIG. 1). That is, while the second back side pattern 12*b* is split at a plurality of points on the back side 10*b* of the substrate, the first back side pattern 11*b* is continuous and not split on the back side 10*b* of the substrate.

Furthermore, the second front side pattern 12*a* is provided with a narrow portion 13*a* where the width is smaller than other portions, this narrow portion 13*a* passing through the split portion in the first front side pattern 11*a*. The first back side pattern 11*b* is provided with a narrow portion 14*a* where the width is smaller than other portions, this narrow portion 14*a* passing through the split portion in the second back side pattern 12*b*. In other words, the second front side pattern 12*a* crosses the first front side pattern 11*a*, having the narrow portion 13*a* between the two adjacent ends of the first front side pattern 11*a*. Likewise, the first back side pattern 11*b* crosses the second back side pattern 12*b*, having the narrow portion 14*a* between the two adjacent ends of the second back side pattern 12*b*. In the following explanation, portions other than the narrow portion 13*a* of the second front side pattern 12*a* may be referred to as "non-narrow portions 13*b*" to distinguish them from the narrow portion 13*a*. Likewise, portions other than the narrow portion 14*a* of the first back side pattern 11*b* may be referred to as "non-narrow portions 14*b*" to distinguish them from the narrow portion 14*a*. That is, the non-narrow portions 13*b* extend oppositely from each other from both ends of the narrow portion 13*a* of the second front side pattern 12*a*. The non-narrow portions 14*b* extend oppositely from each other from both ends of the narrow portion 14*a* of the first back side pattern 11*b*. Note that, however, such distinction only serves for convenience of explanation.

The first front side pattern 11*a*, second front side pattern 12*a*, first back side pattern 11*b*, and second back side pattern 12*b* illustrated in FIG. 4A and FIG. 4B have a thickness (T2) of 0.05 mm. The non-narrow portions 13*b* of the second front side pattern 12*a* illustrated in FIG. 4A have a width (W1) of 4.4 mm, while the narrow portion 13*a* has a width (W2) of 2.8 mm. The non-narrow portions 14*b* of the first back side pattern 11*b* illustrated in FIG. 4B have a width (W1) of 4.4 mm, while the narrow portion 14*a* has a width (W2) of 2.8 mm.

As illustrated in FIG. 3, the substrate 10 is formed with a plurality of through-holes 15. As illustrated in FIG. 4A, the plurality of first front side patterns 11*a* formed on the front side 10*a* of the substrate are each connected to the first back side pattern 11*b* formed on the back side 10*b* of the substrate via the through-holes 15. Similarly, as illustrated in FIG. 4B, the plurality of second back side patterns 12*b* formed on the back side 10*b* of the substrate are each connected to the second front side pattern 12*a* formed on the front side 10*a* of the substrate via the through-holes 15. That is, the plurality of parts of the split first front side pattern 11*a* are electrically conductive to each other via the first back side pattern 11*b*. The plurality of parts of the split second back side pattern 12*b* are electrically conductive to each other via the second front side pattern 12*a*.

As described above, in the antenna device according to the present embodiment, an intersection of two signal lines (first signal line 3*a* and second signal line 3*b*) is achieved at each of the intersecting portions 4 illustrated in FIG. 1. More specifically, at each intersecting portion 4, the first signal line 3*a* passes only the back side 10*b* of the substrate (FIG. 3), and the second signal line 3*b* passes only the front side 10*a* of the substrate (FIG. 3), while, in portions other than the intersecting portions 4, the first signal line 3*a* and second signal line 3*b* both pass both of the front and back sides of the substrate 10.

The signal line 3 in the antenna device according to the present embodiment is formed by the wiring patterns 20 (first front side pattern 11*a*, first back side pattern 11*b*, second front side pattern 12*a*, and second back side pattern 12*b*) formed on both of the front and back sides of the substrate 10 (see FIG. 3). Furthermore, the first front side pattern 11*a* and second front side pattern 12*a* formed on the front side 10*a* of the substrate face the ground conductor 31 via an air layer, while the first back side pattern 11*b* and second back side pattern 12*b* formed on the back side 10*b* of the substrate face the ground conductor 32 via an air layer (see FIG. 4A and FIG. 4B). Therefore, the electric field generated inside the substrate 10 is small and thus the transmission loss is reduced.

Figure 5:
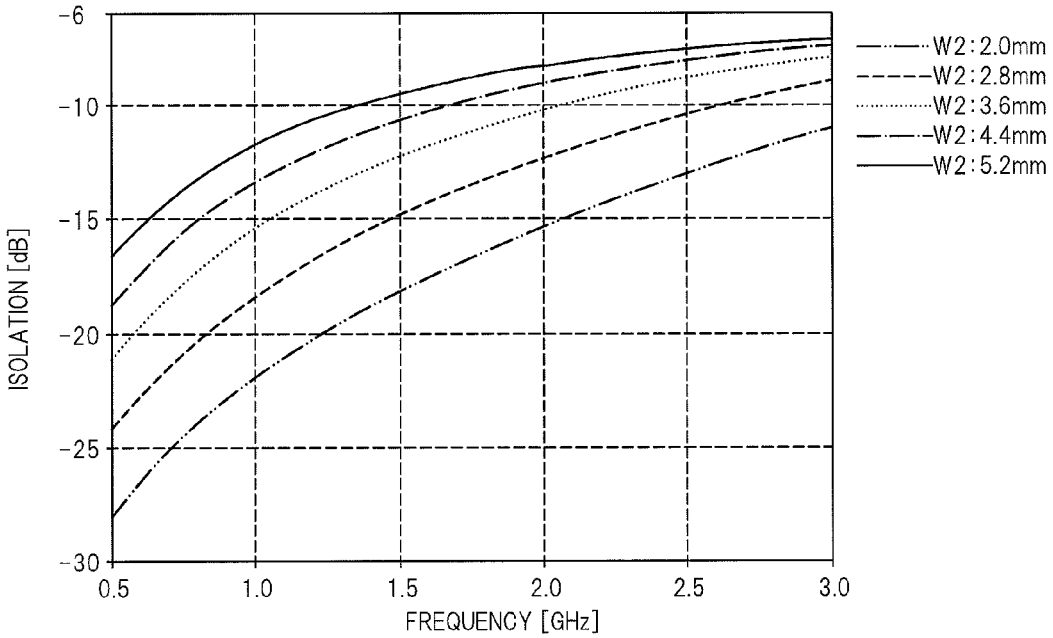
FIG. 5 is a diagram illustrating a result of simulated isolation in the wiring pattern illustrated in FIG. 3.

Moreover, as illustrated in FIG. 3, the second front side pattern 12*a* crosses the first front side pattern 11*a* at the narrow portion 13*a* thereof. The first back side pattern 11*b* crosses the second back side pattern 12*b* at the narrow portion 14*a* thereof. That is, the portion of the second front side pattern 12*a* crossing the first front side pattern 11*a* is narrower than other portions. Similarly, the portion of the first back side pattern 11*b* crossing the second back side pattern 12*b* is narrower than other portions. Therefore, the capacitance between the narrow portion 13*a* of the second front side pattern 12*a* and the ground conductor 31 illustrated in FIG. 4A is smaller than the capacitance between the non-narrow portions 13*b* of the second front side pattern 12*a* and the ground conductor 31 illustrated in the drawing. This suppresses the coupling between the second front side pattern 12*a* and the first front side pattern 11*a*. Similarly, the capacitance between the narrow portion 14*a* of the first back side pattern 11*b* and the ground conductor 32 illustrated in FIG. 4B is smaller than the capacitance between the non-narrow portions 14*b* of the first back side pattern 11*b* and the ground conductor 32 illustrated in the drawing. This suppresses the coupling between the first back side pattern 11*b* and second back side pattern 12*b*. Generally, the isolation is improved at each intersecting portion 4 illustrated in FIG. 1. From the viewpoint of better isolation, the width (W2) of the narrow portions 13*a* and 14*a* illustrated in FIG. 4A and FIG. 4B preferably be as small as possible. The graph of FIG. 5 illustrates a simulation result with respect to the relationship between the width (W2) of the narrow portions 13*a* and 14*a* illustrated in FIG. 4A and FIG. 4B and isolation. From this graph, it is found that the smaller the width (W2) of the narrow portions 13*a* and 14*a*, the better the isolation, irrespective of the signal frequency. Here, the isolation between input-side ends A of the first front side pattern 11*a* and first back side pattern 11*b*, and input-side ends B of the second front side pattern 12*a* and second back side pattern 12*b* illustrated in FIG. 3 was simulated. The non-narrow portions 13*b* and 14*b* illustrated in FIG. 4A and FIG. 4B had a fixed width (W1) of 4.4 mm.

Figure 6:
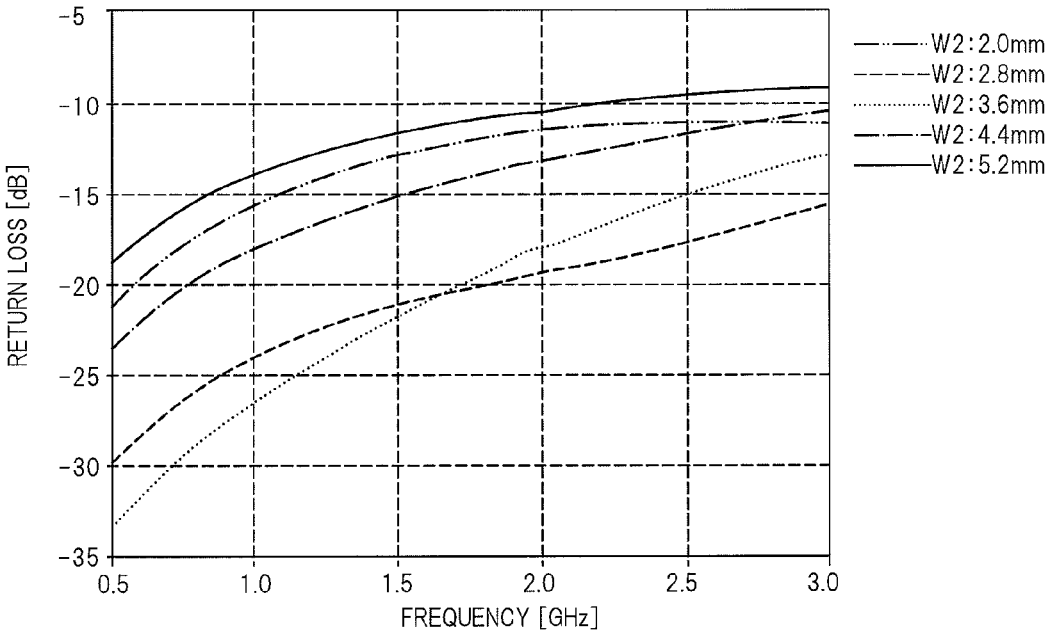
FIG. 6 is a diagram illustrating a result of simulated return loss in the wiring pattern illustrated in FIG. 3.

On the other hand, the return loss increases with an increase in the difference between the width (W2) of the narrow portions 13*a* and 14*a* and the width (W1) of the non-narrow portions 13*b* and 14*b*. The graph illustrated in FIG. 6 illustrates a simulation result with respect to the relationship between the width (W2) of the narrow portions 13*a* and 14*a* illustrated in FIG. 4A and FIG. 4B and the return loss. In this simulation, too, the non-narrow portions 13*b* and 14*b* had a fixed width (W1) of 4.4 mm.

The simulation results illustrated in FIG. 5 and FIG. 6 indicate that, for signals of about 0.5 GHz, the isolation and the return loss can be kept at about −25 dB by setting the width (W1) of the non-narrow portions 13*b* and 14*b* to 4.4 mm and by setting the width (W2) of the narrow portions 13*a* and 14*a* to about 2.8 mm.

Second Embodiment

Next, a second embodiment of the antenna device of the present invention will be described. The basic structure of the antenna device of the present embodiment is the same as that of the antenna device of the first embodiment. Therefore, the common structure will not be described again, and mainly the difference from the antenna device according to the first embodiment will be described below.

As mentioned above, the smaller the width (W2) of the narrow portions 13*a* and 14*a* illustrated in FIG. 4A and FIG. 4B, the better the isolation, but on the other hand, an increase in the difference between the width (W2) of the narrow portions 13*a* and 14*a* and the width (W1) of the non-narrow portions 13*b* and 14*b* increases the return loss due to an impedance mismatch.

Figure 7:
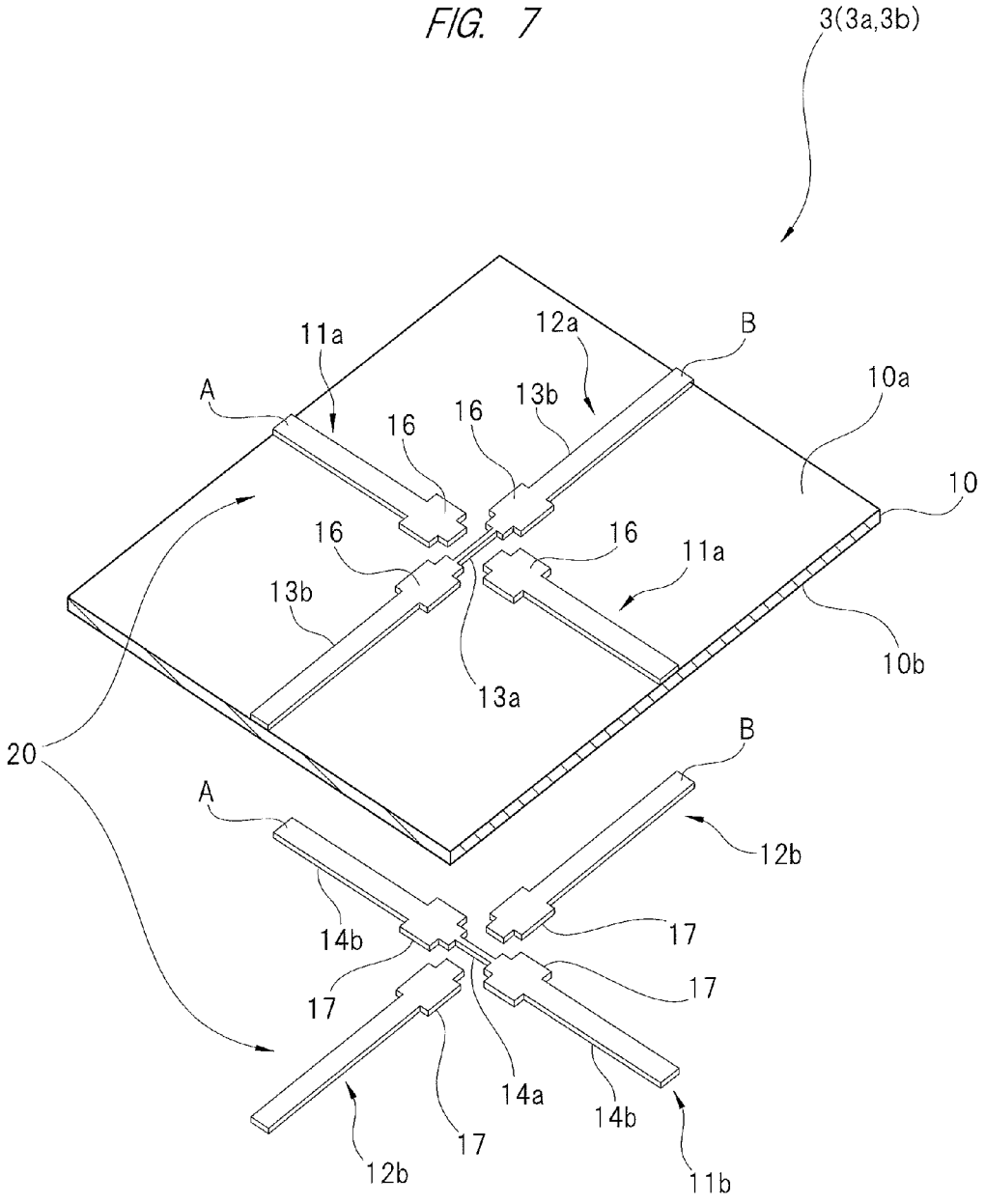
FIG. 7 is a schematic diagram illustrating another example of a wiring pattern.

Therefore, in the present embodiment, as illustrated in FIG. 7, the width of the narrow portions 13*a* and 14*a* is made smaller than the width of these portions in the first embodiment, as well as wide portions (stubs) with a larger width than the non-narrow portions 13*b* and 14*b* are formed in the wiring pattern 20. More specifically, the width of the narrow portions 13*a* and 14*a* illustrated in FIG. 7 is 1.0 mm. Front side wide portions 16 are formed on both sides (front and back) of the narrow portion 13*a* of the second front side pattern 12*a*, and to the first front side pattern 11*a*. Back side wide portions 17 are formed on both sides (front and back) of the narrow portion 14*a* of the first back side pattern 11*b*, and to the second back side pattern 12*b*.

Figure 8:
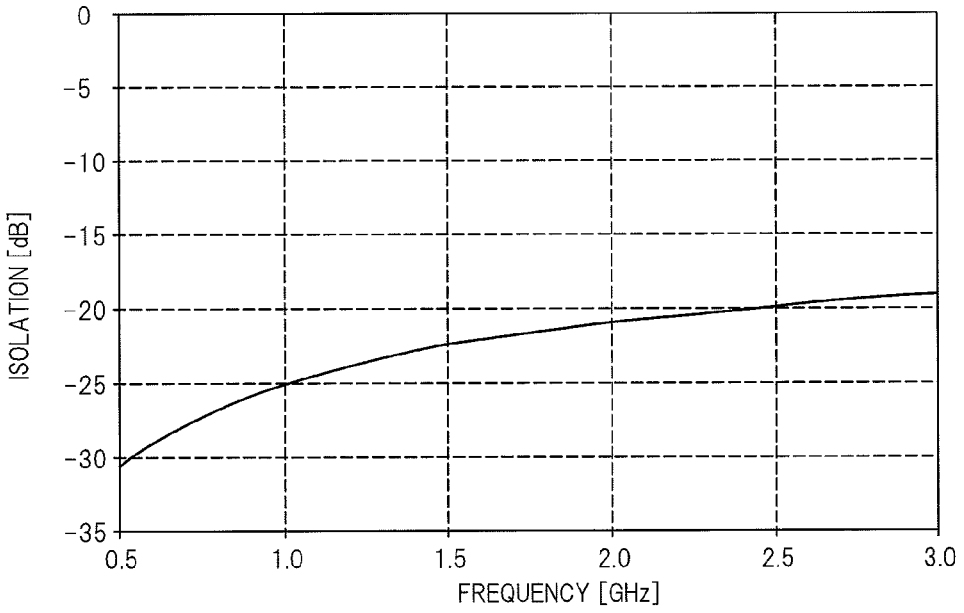
FIG. 8 is a diagram illustrating a result of simulated isolation in the wiring pattern illustrated in FIG. 7.

The graph of FIG. 8 illustrates a simulation result with respect to the isolation between the input-side ends A of the first front side pattern 11*a* and first back side pattern 11*b*, and the input-side ends B of the second front side pattern 12*a* and second back side pattern 12*b* illustrated in FIG. 7. The graph of FIG. 9 illustrates a simulation result with respect to the return loss in the wiring pattern 20 illustrated in FIG. 7.

Figure 9:
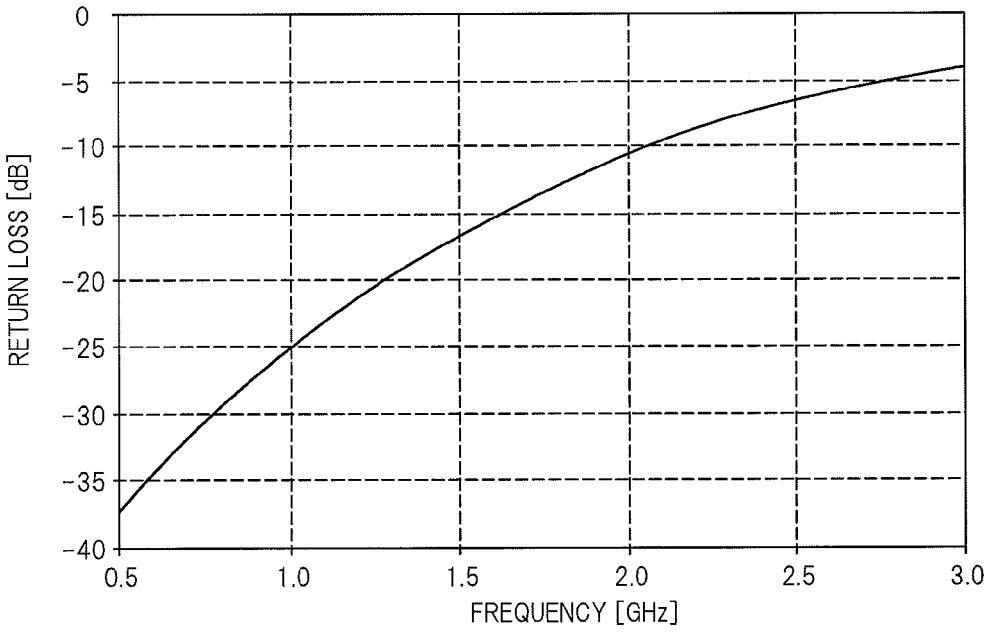
FIG. 9 is a diagram illustrating a result of simulated return loss in the wiring pattern illustrated in FIG. 7.

From the graphs illustrated in FIG. 8 and FIG. 9, it is found that the isolation and the return loss are both improved in the wiring pattern 20 illustrated in FIG. 7 as compared to the wiring pattern illustrated in FIG. 3. More specifically, the isolation is kept at no more than −20 dB in the range of 0.5 to 2.5 GHz. The return loss is kept at no more than −10 dB in the range of 0.5 to 2.0 GHz.

Third Embodiment

Next, a third embodiment of the antenna device of the present invention will be described. The basic structure of the antenna device of the present embodiment is the same as that of the antenna devices of the first and second embodiments. Therefore, the common structure will not be described again, and mainly the difference from the antenna devices according to the first and second embodiments will be described below.

As mentioned above, signals in the frequency range of 700 to 800 MHz are input to the input terminal 1*a* illustrated in FIG. 1, while signals in the frequency range of 1.5 to 2.0 GHz are input to the input terminal 1*b*. That is, the frequency band of the signals traveling through the first signal line 3*a* is different from the frequency band of the signals traveling through the second signal line 3*b*. It is therefore preferable to more reliably prevent the signals traveling through one signal line from coupling to the other signal line.

Figure 10:
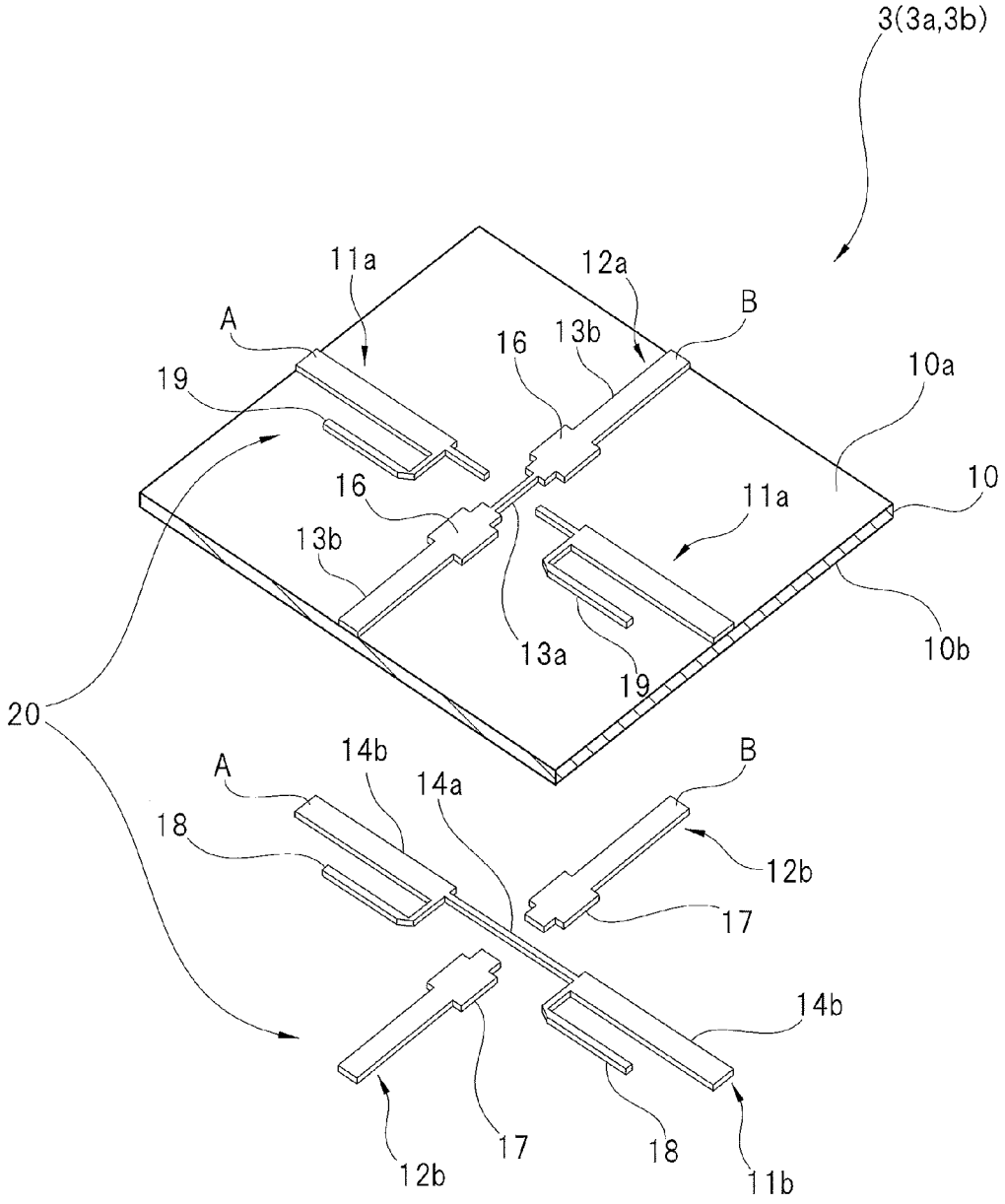
FIG. 10 is a schematic diagram illustrating another example of a wiring pattern.

In the present embodiment, therefore, as illustrated in FIG. 10, filter patterns (open stubs) are added in the wiring pattern 20. More specifically, back side filter patterns 18 are connected to both sides (front and back) of the narrow portion 14*a* of the first back side pattern 11*b*. Also, front side filter patterns 19 corresponding to the back side filter patterns 18 are connected to each of the plurality of parts of the first front side pattern 11*a*.

Front side wide portions 16 are formed on both sides (front and back) of the narrow portion 13*a* of the second front side pattern 12*a*. Back side wide portions 17 corresponding to the front side wide portions 16 are provided to each of the plurality of parts of the second back side pattern 12*b*.

As has been described in the foregoing, the first signal line 3*a* illustrated in FIG. 1 is formed by the first front side pattern 11*a* and first back side pattern 11*b*, while the second signal line 3*b* is formed by the second front side pattern 12*a* and second back side pattern 12*b*. That is, signals in the frequency range of 700 to 800 MHz (hereinafter "first signals") are input to the first front side pattern 11*a* and first back side pattern 11*b* that form the first signal line 3*a*, while signals in the frequency range of 1.5 to 2.0 GHz (hereinafter "second signals") are input to the second front side pattern 12*a* and second back side pattern 12*b* that form the second signal line 3*b*. In other words, the frequency of the first signals input to the first front side pattern 11*a* and first back side pattern 11*b* is lower than the frequency of the second signals input to the second front side pattern 12*a* and second back side pattern 12*b*. And the filter patterns 19 and 18 are provided to the first front side pattern 11*a* and first back side pattern 11*b*, to which the first signals of relatively lower frequency are input.

The back side filter patterns 18 and front side filter patterns 19 have a length that is one fourth of the wavelength (λ) of the second signals. Therefore, the second signals traveling through the second front side pattern 12*a* and second back side pattern 12*b* are reflected, and thereby the coupling of the second signals to the first front side pattern 11*a* and first back side pattern 11*b* is prevented or reduced. That is, coupling of the second signals traveling through the second signal line 3*b* to the first signal line 3*a* is prevented or reduced.

Figure 11:
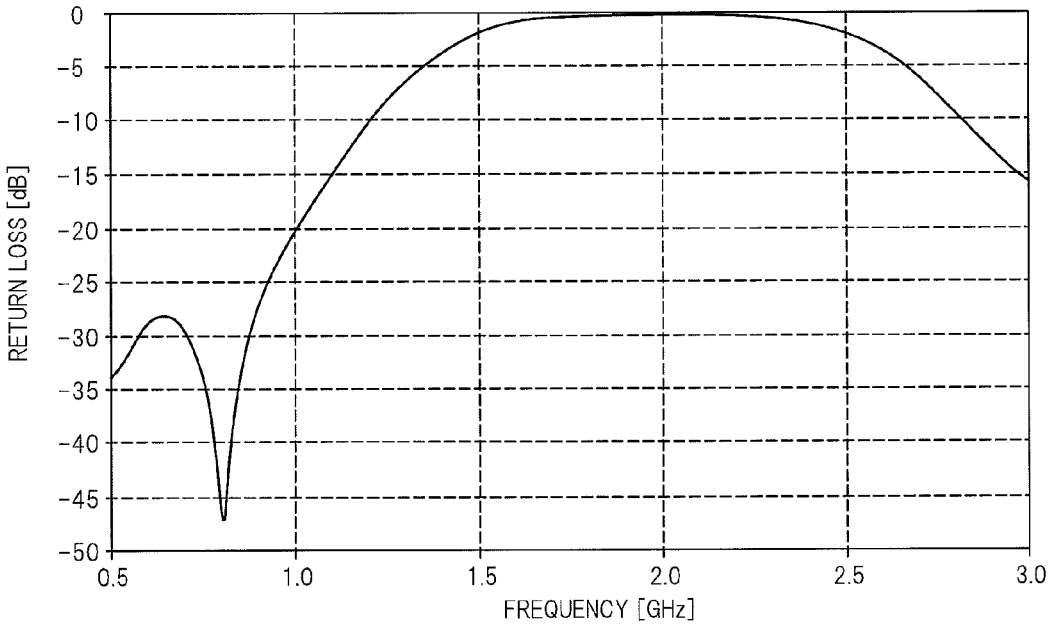
FIG. 11 is a diagram illustrating a result of simulated return loss in the wiring pattern illustrated in FIG. 10.
Figure 12:
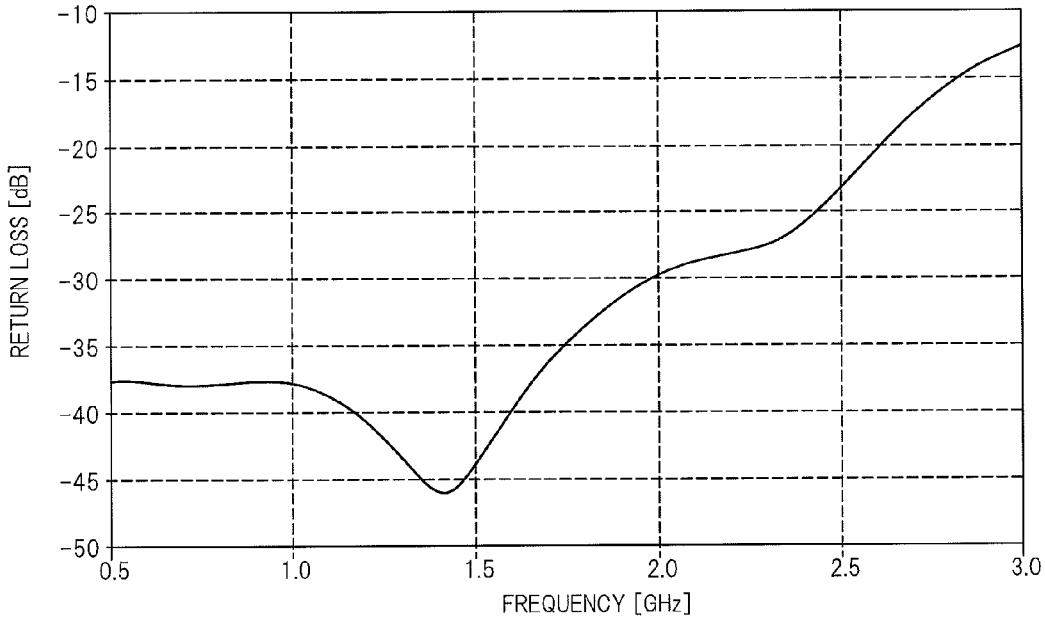
FIG. 12 is a diagram illustrating a result of another simulated return loss in the wiring pattern illustrated in FIG. 10.
Figure 13:
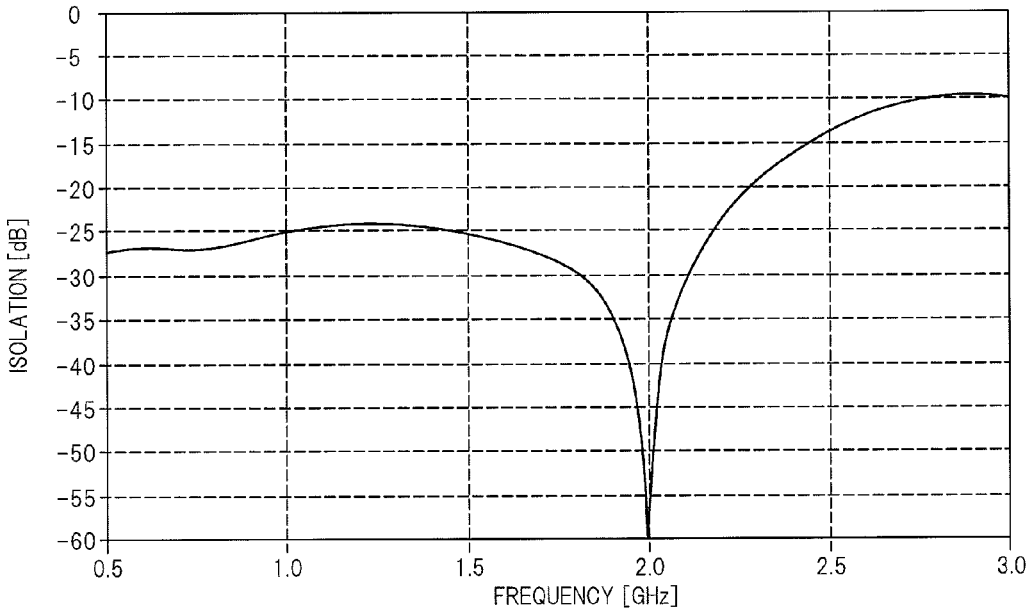
FIG. 13 is a diagram illustrating a result of simulated isolation in the wiring pattern illustrated in FIG. 10.

FIG. 11 is a graph illustrating a simulation result with respect to the return loss at the input-side ends A of the first front side pattern 11*a* and first back side pattern 11*b* illustrated in FIG. 10. FIG. 12 is a graph illustrating a simulation result with respect to the return loss at the input-side ends B of the second front side pattern 12*a* and second back side pattern 12*b* illustrated in FIG. 10. FIG. 13 is a graph illustrating a simulation result with respect to the isolation between the input-side ends A and input-side ends B.

From the graphs illustrated in FIG. 11 to FIG. 13, it is found that both the isolation and the return loss are kept at no more than −25 dB in respective frequency ranges of the first and second signals in the wiring pattern 20 illustrated in FIG. 10.

Figure 14A:
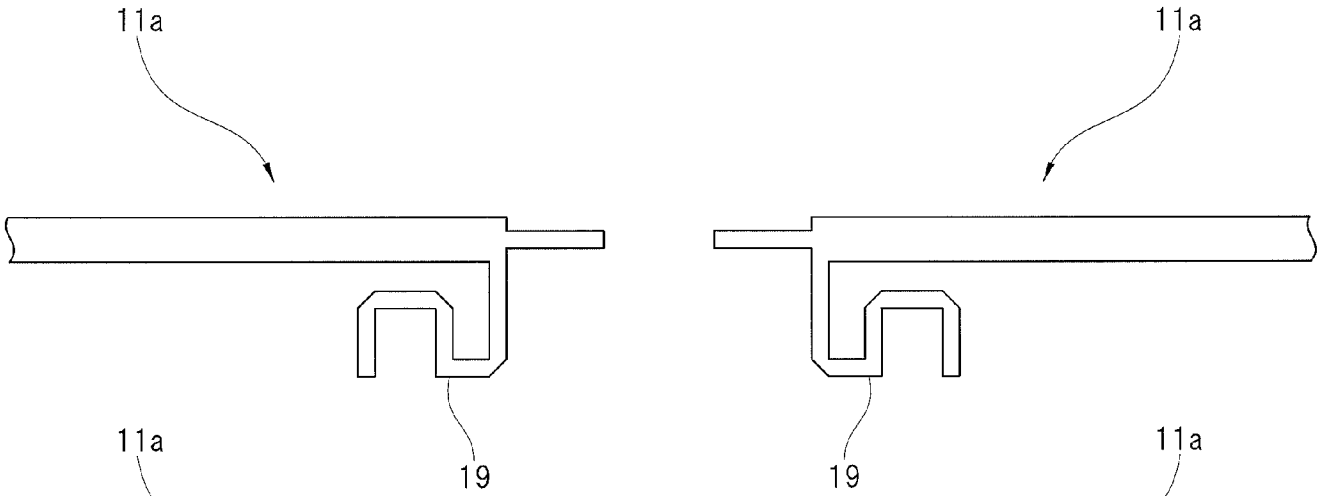
FIG. 14A is an enlarged plan view illustrating a different variation example of a filter pattern.
Figure 14B:
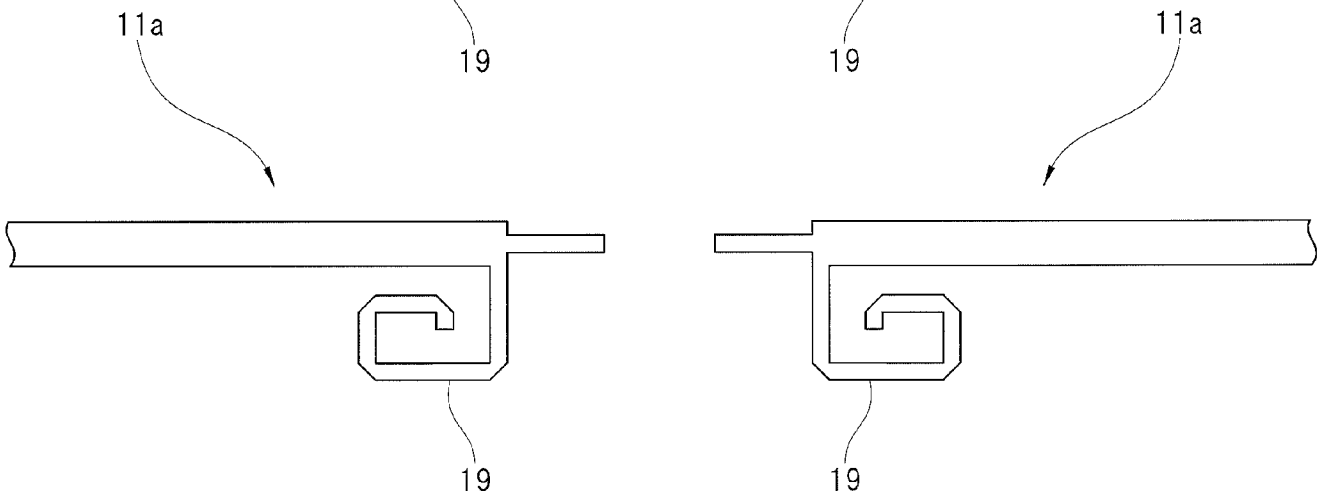
FIG. 14B is an enlarged plan view illustrating a different variation example of a filter pattern.

The shape of the filter patterns 18 and 19 is not limited to the one illustrated in FIG. 10. FIG. 14A and FIG. 14B illustrate some modification examples of the front side filter patterns 19 illustrated in FIG. 10. The front side filter pattern 19 illustrated in FIG. 14A has a meander (zigzag) shape, while the front side filter pattern 19 illustrated in FIG. 14B has a spiral (coil) shape. While FIG. 14A and FIG. 14B only illustrate modification examples of the front side filter pattern 19, the shape of the back side filter patterns 18 illustrated in FIG. 10 can also be modified similarly to the front side filter patterns 19 illustrated in FIG. 14A and FIG. 14B.

The pattern shapes illustrated in FIG. 14A and FIG. 14B have the advantage of smaller installation space while a necessary pattern length is kept, as compared to the linear pattern shape illustrated in FIG. 10. Moreover, the spiral shape illustrated in FIG. 14B has the advantage of reduced influence on the surrounding circuits since the distal end of the filter pattern, at which the voltage is highest, is disposed in the center of the pattern.

The present invention is not limited to the embodiments described above and may be variously modified without departing from the scope of the invention. For example, in the third embodiment illustrated in FIG. 10, filter patterns are added to the first front side pattern 11*a* and first back side pattern 11*b*, while wide portions are added to the second front side pattern 12*a* and second back side pattern 12*b*. However, the wide portions may be added to the first front side pattern 11*a* and first back side pattern 11*b*, while the filter patterns may be added to the second front side pattern 12*a* and second back side pattern 12*b*. Alternatively, the filter patterns may be added to all of first front side pattern 11*a*, first back side pattern 11*b*, second front side pattern 12*a*, and second back side pattern 12*b*. However, if filter patterns are to be added to only part of the pattern, it is preferable to add the filter patterns to the pattern that transmits signals with relatively lower frequency, so as to avoid coupling of the signals with relatively higher frequency to this pattern. This is because the length of the filter patterns depends on the wavelength of the target signals. That is, the filter pattern for avoiding coupling of signals with relatively higher frequency needs a smaller length than that of the filter pattern for avoiding coupling of signals with relatively lower frequency, and thus requires a smaller space for installation.

The invention claimed is:

1. An antenna device including a signal line that distributes input signals to a plurality of antenna elements, wherein the signal line includes:

a substrate;

a pair of ground conductors opposing each other and sandwiching the substrate;

a first front side pattern and a second front side pattern formed on a front side of the substrate;

a first back side pattern formed on a back side of the substrate and paired with the first front side pattern; and a second back side pattern formed on the back side of the substrate and paired with the second front side pattern, while the first front side pattern is split, the second front side pattern passes through a split portion in the first front side pattern and extends in a direction intersecting the first front side pattern, while the second back side pattern is split, the first back side pattern passes through a split portion in the second back side pattern and extends in a direction intersecting the second back side pattern, parts of the split first front side pattern are conductive to each other via the first back side pattern, and parts of the split second back side pattern are conductive to each other via the second front side pattern.

2. The antenna device according to claim 1, wherein the split first front side pattern is connected to the first back side pattern via a through-hole formed in the substrate, and the split second back side pattern is connected to the second front side pattern via a through-hole formed in the substrate.

3. The antenna device according to claim 1, wherein the second front side pattern includes a narrow portion that has a width smaller than that of portions passing through the split portion in the first front side pattern, and the first back side pattern includes a narrow portion that that has a width smaller than that of portions passing through the split portion in the second back side pattern.

4. The antenna device according to claim 3, wherein front side wide portions are formed on both sides of the narrow portion of the second front side pattern, and on the first front side pattern, respectively, and back side wide portions corresponding to the front side wide portions are formed on both sides of the narrow portion of the first backside pattern, and on each of a plurality of parts of the second back side pattern, respectively.

5. The antenna device according to claim 3, wherein front side filter patterns are added on both sides of the narrow portion of the second front side pattern, and on the first front side pattern, respectively, and back side filter patterns corresponding to the front side filter patterns are added on both sides of the narrow portion of the first back side pattern, and on the second back side pattern, respectively.

6. The antenna device according to claim 3, wherein front side wide portions are formed on both sides of the narrow portion of the second front side pattern, back side wide portions corresponding to the front side wide portions are formed on the second back side pattern, backside filter patterns are added on both sides of the narrow portion of the first back side pattern, and front side filter patterns corresponding to the back side filter patterns are added to the first front side pattern.

7. The antenna device according to claim 6, wherein a frequency of signals propagating through the first front side pattern and the first back side pattern is lower than a frequency of signals propagating through the second front side pattern and the second back side pattern.

8. The antenna device according to claim 5, wherein, at least one of filter patterns has a meander shape or a spiral shape.

* * * * *